US011173730B2

(12) United States Patent
Horie

(10) Patent No.: US 11,173,730 B2
(45) Date of Patent: Nov. 16, 2021

(54) RECORDING DEVICE

(71) Applicant: SEIKO EPSON CORPORATION, Tokyo (JP)

(72) Inventor: Seijun Horie, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/029,241

(22) Filed: Sep. 23, 2020

(65) Prior Publication Data

US 2021/0086532 A1 Mar. 25, 2021

(30) Foreign Application Priority Data

Sep. 25, 2019 (JP) ..... JP2019-173894

(51) Int. Cl.

| | |
|---|---|
| ***B41J 11/00*** | (2006.01) |
| ***B41J 29/17*** | (2006.01) |
| ***B41J 29/377*** | (2006.01) |
| ***B41J 15/04*** | (2006.01) |

(52) U.S. Cl.

CPC ..... *B41J 11/007* (2013.01); *B41J 11/00244* (2021.01); *B41J 15/048* (2013.01); *B41J 29/17* (2013.01); *B41J 29/377* (2013.01); *B65H 2301/5144* (2013.01)

(58) Field of Classification Search

CPC .. B41J 11/007; B41J 11/00244; B41J 15/048; B41J 29/17; B41J 29/377; B65H 2301/5144

See application file for complete search history.

(56) References Cited

U.S. PATENT DOCUMENTS

2005/0061421 A1* 3/2005 Inoue ..... B41J 29/38 156/230
2018/0099512 A1* 4/2018 Amari ..... B41J 11/0015
2018/0185884 A1* 7/2018 Jingushi ..... B08B 1/02

FOREIGN PATENT DOCUMENTS

JP 2016-179871 A 10/2016

* cited by examiner

*Primary Examiner* — Henok D Legesse
(74) *Attorney, Agent, or Firm* — Workman Nydegger

(57) ABSTRACT

A recording device including a recording unit that performs recording on a medium by ejecting liquid, a transporting belt that has a base material having a first surface provided with an adhesive layer on which the medium is stuck and a second surface which is a surface opposite to the first surface, and the transporting belt transports the medium, a pressing unit that presses the medium against the transporting belt, a cleaning member that cleans the adhesive layer by contacting the adhesive layer, a storage unit in which water for cleaning the cleaning member is stored, and a cooling unit having a flow path through which water flows and a contacting unit that contacts the second surface. The contacting unit is coupled to the flow path, and contacts the second surface downstream of the pressing unit and upstream of the cleaning member in the revolving direction of the transporting belt.

5 Claims, 4 Drawing Sheets

RECORDING DEVICE

The present application is based on, and claims priority from JP Application Serial Number 2019-173894, filed Sep. 25, 2019, the disclosure of which is hereby incorporated by reference herein in its entirety.

BACKGROUND

1. Technical Field

The present disclosure relates to a recording device.

2. Related Art

JP-A-2016-179871 describes recording device including a recording unit that records on a medium by ejecting liquid, and a transporting belt that has an adhesive layer and transports the medium attached to the adhesive layer. The recording device includes a pressing unit that presses the medium against the transporting belt, a cleaning member that cleans the adhesive layer by contacting the adhesive layer, and a storage unit that stores water for cleaning the cleaning member.

The adhesive layer is generally formed of a thermoplastic resin. Therefore, the adhesive layer becomes soft when its temperature is high, and the adhesive layer becomes hard when its temperature is low. When the cleaning member contacts adhesive layer which is in a soft state, the adhesive layer may be damaged. When the adhesive layer is damaged, the adhesive layer tends to deteriorate.

SUMMARY

A recording device for solving the above-described problems includes a recording unit that performs recording on a medium by ejecting liquid, a transporting belt that has a base material having a first surface provided with an adhesive layer on which the medium is stuck and a second surface which is a surface opposite to the first surface, the transporting belt transporting the medium, a pressing unit that presses the medium against the transporting belt, a cleaning member that cleans the adhesive layer by contacting the adhesive layer, a storage unit in which water for cleaning the cleaning member is stored, and a cooling unit having a flow path through which water flows and a contacting unit that contacts the second surface, the contacting unit being coupled to the flow path, wherein the flow path extends toward the storage unit so that water flows from the cooling unit toward the storage unit, and the contacting unit contacts the second surface downstream of the pressing unit and upstream of the cleaning member in the revolving direction of the transporting belt.

DESCRIPTION OF EXEMPLARY EMBODIMENTS

One exemplary embodiment of a recording device will be described below with reference to the accompanying drawings. The recording device is, for example, an ink jet-type printer that records an image such as characters and photographs on a medium such as a sheet and a fiber by ejecting ink, which is an example of liquid. In following embodiments, the recording device constitutes a recording system together with a plurality of devices.

First Embodiment

Figure 1:
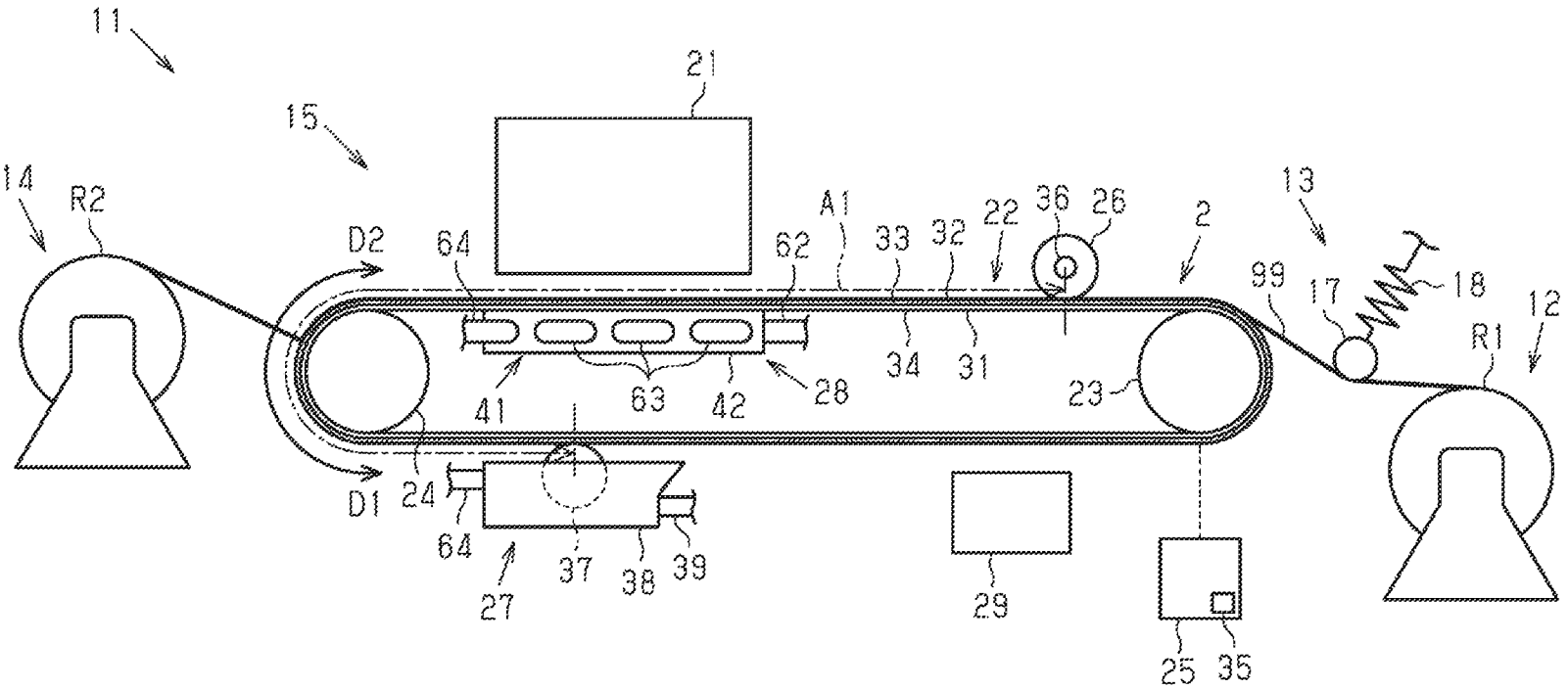
FIG. 1 is a side view schematically illustrating a first exemplary embodiment of a recording device including a recording device.

As illustrated in FIG. 1, the recording system 11 includes, for example, a holding device 12, a tension adjusting device 13, a collecting device 14, and a recording device 15.

The holding device 12 holds a roll body on which a medium 99 is wound. The holding device 12 rotatably holds the roll body. The roll body held by the holding device 12 is a first roll body R1 on which the medium 99 before recording is wound. The medium 99 unwound from the first roll body R1 is transported from the holding device 12 toward the recording device 15. In other words, the holding device 12 supplies the medium 99 to the recording device 15.

The tension adjusting device 13 includes, for example, a contact member 17 and an elastic member 18. The contact member 17 contacts the medium 99 between the holding device 12 and the recording device 15. The contact member 17 according to the first embodiment contacts the surface recorded by the recording device 15 with respect to the medium 99. The contact member 17 may be, for example, a cylindrical rod or a roller.

The elastic member 18 has elasticity. The elastic member 18 is attached to the contact member 17. The elastic member 18 is, for example, a spring. Depending on the magnitude of tension applied to the medium 99 between the holding device 12 and the recording device 15, the elastic member 18 stretches and contracts. In other words, when the tension applied to the medium 99 is large, the elastic member 18 contracts. When the tension applied to the medium 99 is small, the elastic member 18 stretches. In this way, the tension adjusting device 13 adjusts the tension of the medium 99 between the holding device 12 and the recording device 15 to be constant.

The collecting device 14 holds the roll body on which the medium 99 is wound. The collecting device 14 rotatably holds the roll body. The roll body held by the collecting device 14 is a second roll body R2 on which the medium 99 after passing through the recording device 15 is wound. In the recording system 11, the collecting device 14 winds the medium 99 from the recorder 15. In other words, the collecting device 14 collects the medium 99 recorded by the recording device 15. The collecting device 14 according to the first embodiment collects the medium 99 by rotating the second roll body R2.

The recording device 15 includes a recording unit 21 and a transporting belt 22. The recording device 15 includes a first roller 23, a second roller 24, and a driving unit 25. The recording device 15 includes a pressing unit 26, a cleaning unit 27, and a cooling unit 28. The recording device 15 according to the first embodiment includes a drying unit 29.

The recording unit 21 employs a so-called ink-jet method that performs recording on the medium 99 by ejecting liquid. The recording unit 21 is, for example, a head. The recording unit 21 may be a serial head that scans with respect to the medium 99, or may be a line head that extends over substantially the same range as the width of the medium 99.

Note that the recording unit 21 is not limited to an ink-jet method, and may be an electrophotographic method in which an image and the like are fixed on the medium 99 by various photosensitive means after a solid toner is applied.

The recording device 15 has a transporting unit 2. The transporting unit 2 includes a transporting belt 22, the first roller 23, and the second roller 24. The transporting belt 22 has a base material 31. The base material 31 is disposed in an endless shape. The base material 31 has a first surface 33 on which an adhesive layer 32 on which the medium 99 is stuck is disposed and a second surface 34 that is a surface opposite to the first surface 33. The first surface 33 is a surface that serves as an outer peripheral surface of the base material 31. The second surface 34 is a surface that serves as an inner peripheral surface of the base material 31.

The adhesive layer 32 is disposed on the first surface 33. The adhesive layer 32 has adhesiveness. The adhesive layer 32 is formed of an adhesive having adhesiveness. The adhesive layer 32 is formed by being applied the adhesive onto the first surface 33. The adhesive is, for example, a thermoplastic resin. The adhesive layer 32 is formed over the entire periphery of the first surface 33. The adhesive force of the adhesive layer 32 decreases with use of the recording device 15, passage of time, and the like.

The transporting belt 22 transports the medium 99 attached to the adhesive layer 32. The medium 99 is recorded by the recording unit 21 while being transported by the transporting belt 22. In other words, the recording unit 21 is positioned so as to face the first surface 33 with respect to the base member 31. The recording unit 21 according to the present embodiment is positioned above the transporting unit 2.

The transporting belt 22 is disposed in an endless shape. The transporting belt 22 is wound around a first roller 23 and a second roller 24. As a result, the second surface 34 of the base material 31 contacts the first roller 23 and the second roller 24.

The conveyor belt 22 revolves around the first roller 23 and the second roller 24 in parallel with the rotation of the first roller 23 and the second roller 24. By revolving the transporting belt 22, the medium 99 is unwound from the first roll body R1. The transporting belt 22 transports the medium 99 by revolving. The medium 99 transported by the transporting belt 22 is collected by the collecting device 14. In other words, the collecting device 14 separates the medium 99 from the transporting belt 22.

The first roller 23 is configured to be rotatable. In the first embodiment, the first roller 23 is coupled to the driving unit 25.

The second roller 24 is configured to be rotatable. In the first embodiment, the second roller 24 is driven by the revolving of the transporting belt 22. In other words, the second roller 24 is driven by the rotation of the first roller 23.

The driving unit 25 is, for example, a motor. When the driving unit 25 is driven, the first roller 23 rotates. When the first roller 23 rotates, the transporting belt 22 revolves. In this way, the driving unit 25 transmits a driving force to the first roller 23 to drive the transporting belt 22. The driving unit 25 according to the present embodiment can rotate the first roller 23 in both the first direction and the second direction, which is the opposite direction to the first direction. As such, the transporting belt 22 can revolve in both a revolving direction D1 for transporting the medium 99 and a reverse revolving direction D2 in which the medium 99 is reversely transported. The revolving direction D1 is a direction in which the transporting belt 22 revolves when the medium 99 is transported from the holding device 12 toward the recording device 15. In FIG. 1, the counterclockwise direction is the revolving direction D1 of the transporting belt 22.

The driving unit 25 includes an encoder 35. The encoder 35 is configured to detect the amount of rotation, the speed of rotation, and the like of the first roller 23. By the encoder 35, the first roller 23 can rotate with high accuracy.

The pressing unit 26 is positioned outside the transporting belt 22. As such, the pressing unit 26 is positioned so as to face the first surface 33 with respect to the base member 31. The pressing unit 26 according to the first embodiment is positioned above the transporting belt 22 (transporting unit 2).

The pressing unit 26 presses the medium 99 against the transporting belt 22. As a result, the medium 99 is attached to the adhesive layer 32. The pressing unit 26 according to the first embodiment presses the medium 99 downward toward the transporting belt 22. The pressing unit 26 sequentially attaches the medium 99 to the adhesive layer 32 by revolving the transporting belt 22 in the revolving direction D1.

The pressing unit 26 may be, for example, a rod or a roller. Alternatively, the pressing unit 26 may press the medium 99 against the adhesive layer 32 by wind pressure by applying an airflow toward a peripheral surface of the transporting belt 22 with a fan. The pressing unit 26 effectively applies the medium 99 to the adhesive layer 32 by reciprocating a predetermined distance on the peripheral surface of the transporting belt 22, for example.

The pressing unit 26 includes a heating unit 36 that heats the medium 99. The heating unit 36 is, for example, a heating element that generates heat. In this case, the pressing unit 26 is, for example, a heat roller. When the heating unit 36 generates heat, the pressing unit 26 becomes elevated temperature. When pressing unit 26 contacts the medium 99, the medium 99 is heated. In this way, the heating unit 36 heats the medium 99. The pressing unit 26 presses the medium 99 against the transporting belt 22 while heating the medium 99, so that the medium 99 is easily applied to the adhesive layer 32. The pressing unit 26 is in line contact with the medium 99, and the temperature of the medium 99 and the adhesive layer 32 is heated to a range of about 40° C. to about 80° C. The heating unit 36 is an example of a heating unit heating the medium 99 upstream of the recording unit 21 in the revolving direction D1.

The cleaning unit 27 is positioned outside the transporting unit 2. Thus, the cleaning unit 27 is positioned so as to face the first surface 33 with respect to the base material 31. The cleaning unit 27 according to the first embodiment is positioned below the transporting unit 2.

The cleaning unit 27 includes a cleaning member 37 and a storage unit 38. In the recording device 15, as the recording unit 21 records on the medium 99, sometimes liquid adhere to the adhesive layer 32. The cleaning unit 27 cleans the adhesive layer 32 in order to remove the liquid adhered to the adhesive layer 32.

The cleaning member 37 cleans the adhesive layer 32 by contacting the adhesive layer 32. The cleaning member 37 according to the first embodiment contacts the transporting unit 2 from below. The cleaning member 37 according to the first embodiment is a rotating roll brush, but the cleaning member may be a non-rotating brush or a wiper. The cleaning member 37 according to the first embodiment cleans the adhesive layer 32 by rotating in a state of being in contact with the adhesive layer 32. The cleaning member 37 sequentially contacts the adhesive layer 32 by revolving the transporting belt 22 in the revolving direction D1. The cleaning member 37 is contaminated by cleaning the adhesive layer 32.

The storage unit 38 is configured to store water. The storage unit 38 stores water for cleaning the cleaning member 37. The storage unit 38 according to the first embodiment has a water drain unit 39 for draining the stored water. The water stored in the storage unit 38 is drained as appropriate through the water drain unit 39.

The cleaning member 37 is positioned in the storage unit 38. The cleaning member 37 is positioned so as to be immersed in water stored in the storage unit 38. The cleaning member 37 according to the first embodiment is cleaned by rotating in a state of being contact with water. The cleaning member 37 may be cleaned, for example, by moving so as to sink in water stored in the storage unit 38. The cleaning member 37 becomes wetted with water by being cleaned.

The cleaning unit 27 according to the first embodiment effectively cleans the adhesive layer 32 by bringing the cleaning member 37 wetted with water into contact with the adhesive layer 32. By cleaning the adhesive layer 32 using water, the liquid adhering to the adhesive layer 32 is effectively removed. In other words, by contacting the cleaning member 37 wetted with water, the liquid adhering to the adhesive layer 32 is effectively removed. When the cleaning member 37 cleans the adhesive layer 32, the transporting belt 22 is wetted with water.

The cooling unit 28 includes a flow path 41 and a contacting unit 42. In the flow path 41, water flows. The portion of the cooling unit 28 through which water flows is the flow path 41.

The contacting unit 42 connects to the flow path 41. The contacting unit 42 is positioned inward of the transporting belt 22. As such, the contacting unit 42 contacts the second surface 34.

The contacting unit 42 contacts the second surface 34 downstream of the pressing unit 26 and upstream of the cleaning member 37 in the revolving direction D1 of the transporting belt 22. In other words, the contacting unit 42 is disposed on the peripheral surface of the transporting belt 22 so as to contact the region A1 that is downstream of the pressing unit 26 and upstream of the cleaning member 37 in the revolving direction D1 of the transporting belt 22.

The contacting unit 42 According to the first embodiment is opposed to the recording unit 21 with the transporting belt 22 interposed therebetween. In other words, the recording unit 21 is opposed to the region A1 with respect to the transporting belt 22. As such, the recording unit 21 performs recording on the portion supported by the contact unit 42 with respect to the medium 99.

Figure 2:
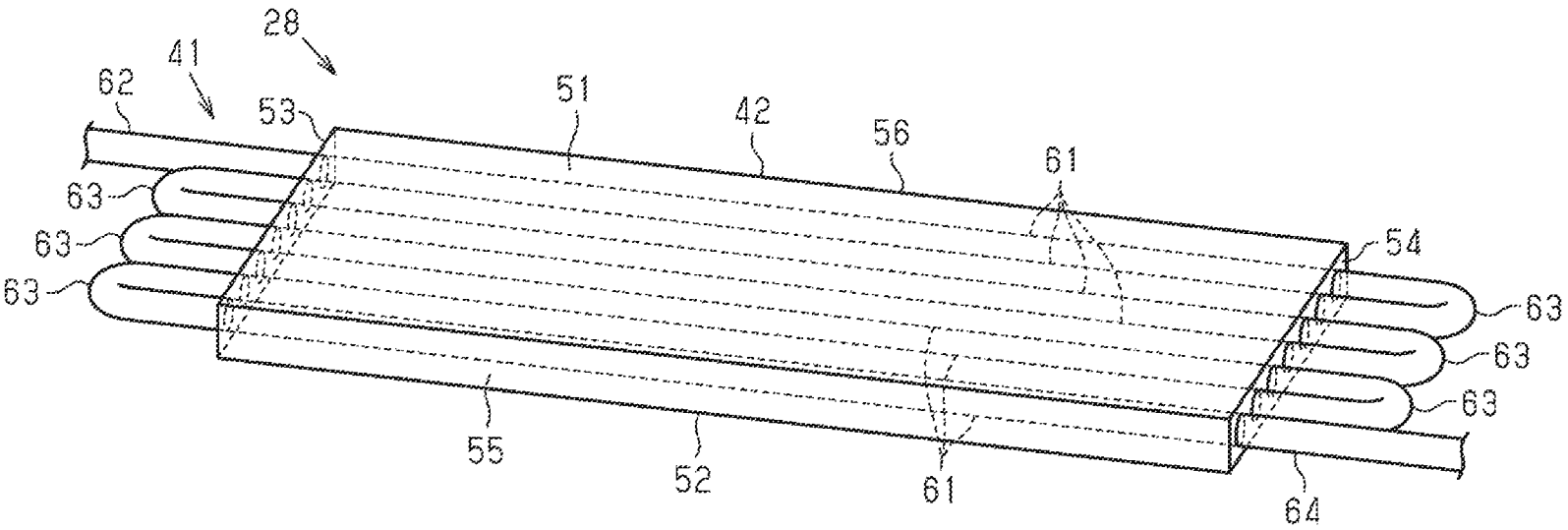
FIG. 2 is a perspective view of a cooling unit.

As illustrated in FIG. 2, the contacting unit 42 According to the first embodiment is, for example, a substantially rectangular parallelepiped. Thus, the contact part 42 includes a first cooling surface 51, a second cooling surface 52, a third cooling surface 53, a fourth cooling surface 54, a fifth cooling surface 55, and a sixth cooling surface 56. The contacting unit 42 is formed from metal such as aluminum, for example.

The first cooling surface 51 is a surface that contacts the transporting belt 22. In other words, in the first embodiment, the first cooling surface 51 faces upward in the contacting unit 42. The first cooling surface 51 contacts the second surface 34 with respect to the base material 31. In other words, the first cooling surface 51 is also said to be a cooling surface that can cool the transporting belt 22 in contact with the second surface 34.

The second cooling surface 52 is a surface opposite to the first cooling surface 51 in the contacting unit 42. In other words, the second cooling surface 52 faces downward in the contacting unit 42.

The third cooling surface 53, the fourth cooling surface 54, the fifth cooling surface 55, and the sixth cooling surface 56 are connected to the first cooling surface 51 and the second cooling surface 52. The fourth cooling surface 54 is a surface opposite to the third cooling surface 53 in the contacting unit 42. The sixth cooling surface 56 is a surface opposite to the fifth cooling surface 55 in the contacting unit 42.

The corner at a portion where the first cooling surface 51 and the fifth cooling surface 55 intersect and a corner at a portions where the first cooling surface 51 and the sixth cooling surface 56 intersect may be chamfered. As a result, when the second surface 34 is revolving while sliding along the first cooling surface 51, the second surface 34 can be prevented from becoming scratched by the angle. Thus, deterioration of the base material 31 can be suppressed.

The contacting unit 42 According to the first embodiment includes a plurality of through holes 61. The contacting unit 42 has, for example, seven through holes 61.

The plurality of the through holes 61 in the first embodiment are formed by extruding the contacting unit 42. The plurality of the through holes 61 extend in one direction in the contacting unit 42. The plurality of the through holes 61 are arranged in a row in the contacting unit 42. The through hole 61 according to the first embodiment opens on the third cooling surface 53 and the fourth cooling surface 54. In other words, the plurality of the through holes 61 are arranged in a row on the third cooling surface 53 and the fourth cooling surface 54.

The through hole 61 constitutes a part of the flow path 41. In other words, the flow path 41 is formed in the contacting unit 42, and water flows into the through hole 61 as a part of the flow path 41. The contacting unit 42 is cooled by water flowing through the through hole 61. The contacting unit 42 is cooled and thereby the transporting belt 22 is cooled. Thus, the adhesive layer 32 is cooled. In this way, the cooling unit 28 according to the first embodiment cools the adhesive layer 32. In the first embodiment, the through hole 61 is disposed in the contacting unit 42 and thereby the contacting unit 42 connects to the flow path 41.

The flow path 41 according to the first embodiment is constituted by at least one through hole 61, a supplying pipe 62, at least one connecting pipe 63, and a discharging pipe 64. In other words, the cooling unit 28 of the present embodiment includes, in addition to the contacting unit 42, the supplying pipe 62, the connecting pipe 63, and the discharging pipe 64.

In the first embodiment, the supplying pipe 62 is coupled to one through hole 61. The supplying pipe 62 is coupled to the through hole 61 in the third cooling surface 53. The supplying pipe 62 according to the first embodiment is coupled to one through hole 61 positioned at the end of the seven through holes 61 arranged in the third cooling surface 53. Furthermore, the supplying pipe 62 is constituted by flexible resin or metal such as SUS, for example.

Note that the supplying pipe 62 may be constituted by a material having a lower thermal conductivity, such as resin, than metal. As a result, atmospheric heat and the like from the environment in which the recording device 15 is disposed is difficult to transfer to the water passing through the supplying pipe 62, and it is possible to suppress a reduction in the cooling effect of the contacting unit 42.

The supplying pipe 62 is coupled to a water source that can supply water. For example, the supplying pipe 62 is coupled to a water supply pipe of a private facility or a water supply pipe of a camp facility as the water source. As a result, water is supplied to the flow path 41.

A plurality of connecting pipes 63 are disposed in the cooling unit 28 according to the first embodiment. The connecting pipe 63 connects the through holes 61 to each other.

Note that the supply of water from the water source to the flow path 41 via the supplying pipe 62 may use a water head difference due to gravity, or may be actively supplied with water pressure by an electric pump or the like.

The connecting pipe 63 connects two adjacent through holes 61 on the third cooling surface 53. On the third cooling surface 53, one of the seven through holes 61 is coupled to the supplying pipe 62, and six are coupled to the connecting pipe 63. Accordingly, three connecting pipes 63 are attached to the third cooling surface 53.

The connecting pipe 63 connects two adjacent through holes 61 on the fourth cooling surface 54. On the fourth cooling surface 54, one of the seven through holes 61 is coupled to the discharging pipe 64, and six are coupled to the connecting pipe 63. Accordingly, three connecting pipes 63 are attached to the fourth cooling surface 54.

In the first embodiment, the discharging pipe 64 is coupled to one through hole 61. The discharging pipe 64 is coupled to the through hole 61 on the fourth cooling surface 54. The discharging pipe 64 according to the first embodiment is coupled to one through hole 61 positioned at the end of the seven through holes 61 arranged in the fourth cooling surface 54. The discharging pipe 64 according to the first embodiment is coupled to a through hole 61 different from the through hole 61 to which the supplying pipe 62 is connected. In other words, the discharging pipe 64 according to the first embodiment is coupled to a through hole 61 arranged at a position point-symmetrical to the through hole 61 to which the supplying pipe 62 is connected with respect to the geometric center of the first cooling surface 51. In other words, the discharging pipe 64 is coupled to the through hole 61 coupled to the connecting pipe 63 on the third cooling surface 53. As a result, the flow path 41 extends so as to meander in the cooling unit 28.

The discharging pipe 64 is a pipe for discharging water from the flow path 41. As a result, the water flows from the supplying pipe 62 toward the discharging pipe 64 in the flow path 41. The water flows from the supplying pipe 62 toward the discharging pipe 64 by water pressure from the water source. Furthermore, the discharging pipe 64 is constituted by flexible resin or metal such as SUS, for example.

The discharging pipe 64 is coupled to the storage unit 38. In other words, the flow path 41 extends toward the storage unit 38 so that the water flows from the cooling unit 28 toward the storage unit 38. As a result, the water used for cooling the adhesive layer 32 is reused as the water for cleaning the cleaning member 37.

Each of the supplying pipe 62, the connecting pipe 63, and the discharging pipe 64 may be coupled to the through hole 61 via a bushing formed of rubber.

In the present embodiment, the water used for cooling the adhesive layer 32 flows in the flow path 41 so as to cool the adhesive layer 32 from upstream toward downstream in the revolving direction D1. In other words, the water supplied from the water source cools the portion upstream in the revolving direction D1 of the adhesive layer 32, and then cools the portion downstream in the revolving direction D1 of the adhesive layer 32. In this case, the portion upstream in the revolving direction D1 in the adhesive layer 32 is cooled by water at a relatively low temperature. This is because when water supplied from a water supply pipe of a private facility or a water supply pipe of a camp facility is used, the temperature of the water is generally lower than the temperature of the adhesive layer 32 heated by the heating unit 36. In the region A1, the temperature increases from downstream in the revolving direction D1 toward the upstream. Therefore, when the portion upstream in the revolving direction D1 in the adhesive layer 32 is cooled with water at a low temperature, the cooling efficiency of the adhesive layer 32 is improved.

Figure 3:
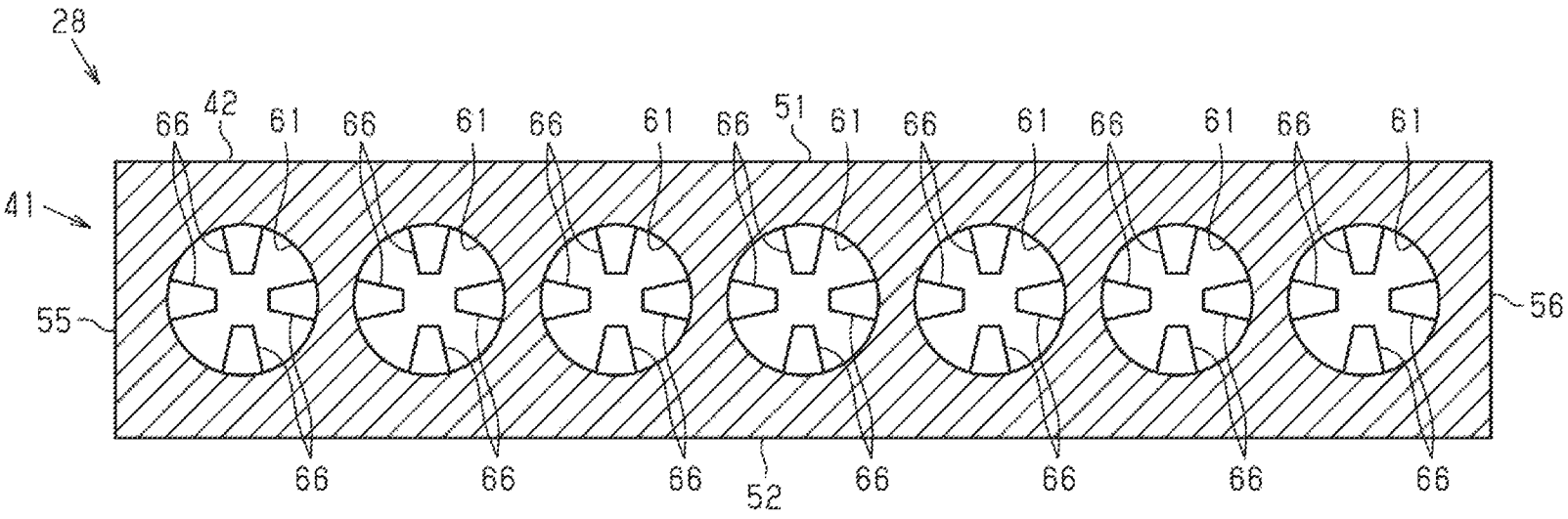
FIG. 3 is a cross-sectional view of a cooling unit.

As illustrated in FIG. 3, in the first embodiment, at least one protrusion 66 is disposed on the inner surface of the flow path 41. In the first embodiment, four protrusions 66 are disposed on the inner surface of the flow path 41. A protrusion 66 protrudes from an interior surface of the flow path 41. In the present embodiment, the protrusion 66 protrudes from the inner surface of the through hole 61. The protrusion 66 increases the contact area between the flow path 41 and the water.

As illustrated in FIG. 1, the drying unit 29 is disposed outward of the transporting belt 22 (transporting unit 2). Thus, the drying unit 29 is positioned so as to be opposed to the first surface 33 with respect to the base material 31. The drying unit 29 according to the first embodiment is positioned below the transporting unit 2.

The drying unit 29 dries the adhesive layer 32 wetted with water by the cleaning of the cleaning unit 27. The drying unit 29 dries the adhesive layer 32 by, for example, blowing hot air to the transporting belt 22. The drying unit 29 according to the first embodiment blows hot air from below with respect to the transporting belt 22 (transporting unit 2). The drying unit 29 sequentially dries the adhesive layer 32 wetted with water by that revolving the transporting belt 22. At this time, the adhesive layer 32 is heated by the drying unit 29.

Next, a series of operations of the recording device 15 will be described while focusing on specific regions of the peripheral surface of the transporting belt 22.

First, the pressing unit 26 presses the medium 99 with respect to a specific region of the peripheral surface of the transporting belt 22. Next, the recording unit 21 performs recording with respect to the medium 99 applied to the specific region. At this time, the specific region is cooled by the cooling unit 28. Next, the medium 99 applied to the specific region is separated from the transporting belt 22. Next, the cleaning member 37 cleans the specific region. Next, the drying unit 29 dries the specific region. Next, the pressing unit 26 presses the medium 99 again with respect to the specific region. At this time, because the specific region is heated by the drying unit 29, the medium 99 is more likely to be applied. In this way, the image is sequentially recorded on the medium 99 by that revolving the transporting belt 22.

Next, functions and effects according to the first embodiment will be described.

(1) In the cooling unit 28, the contacting unit 42 is cooled by water flowing through the flow path 41. The contacting unit 42 contacts the second face 34 and thereby the cooling unit 28 cools the transporting belt 22. The contacting unit 42 contacts the second surface 34 downstream of the pressing unit 26 and upstream of the cleaning member 37 in the revolving direction D1 of the transporting belt 22. Therefore, the cleaning member 37 contacts the adhesive layer 32 cooled by the cooling unit 28.

Because the adhesive layer 32 is generally formed of a thermoplastic resin, it is cured when cooled. Therefore, by cooling the adhesive layer 32 by the cooling unit 28, damage to the adhesive layer 32 due to contact the cleaning member 37 can be reduced. Thus, deterioration of the adhesive layer 32 can be suppressed.

(2) There is a heating unit 36 heats the medium 99 upstream of the recording unit 21 in the revolving direction D1. In this case, when the heating unit 36 heats the medium 99, the medium 99 becomes easily applied to the adhesive layer 32. The reason for this is because the adhesive layer 32 is generally formed of a thermoplastic resin, and therefore, when it is heated, the adhesive force is improved. On the other hand, when the heat of the heated medium 99 is transferred to the recording unit 21, the recording unit 21 may be adversely affected. In this respect, according to the first embodiment described above, the cooling unit 28 cools the transporting belt 22 at a position opposed to the recording unit 21 with the transporting belt 22 interposed therebetween, and thus the heat transferred from the medium 99 to the recording unit 21 can be reduced.

(3) The contacting unit 42 is made of metal. In this case, heat is easily transferred from the transporting belt 22 to the contacting unit 42, and thus the cooling efficiency of the transporting belt 22 by the cooling unit 28 is improved.

(4) On an inner surface of the flow path 41, a protrusion 66 protruding from the inner surface of the flow path 41 is disposed. In this case, the surface area of the inner surface of the flow path 41 in which water contacts is increased by the protrusion 66. As a result, the heat is easily transferred from the transporting belt 22 to the contacting unit 42, and thus the cooling efficiency of the transporting belt 22 by the cooling unit 28 is improved.

Second Embodiment

Next, a second embodiment will be described. In the second embodiment, the position of the contacting unit is different compared to the first embodiment. Additionally, a description of the same configuration as that of the first embodiment will be omitted. The contacting unit of the present embodiment is referred to as a contacting unit 42A.

Figure 4:
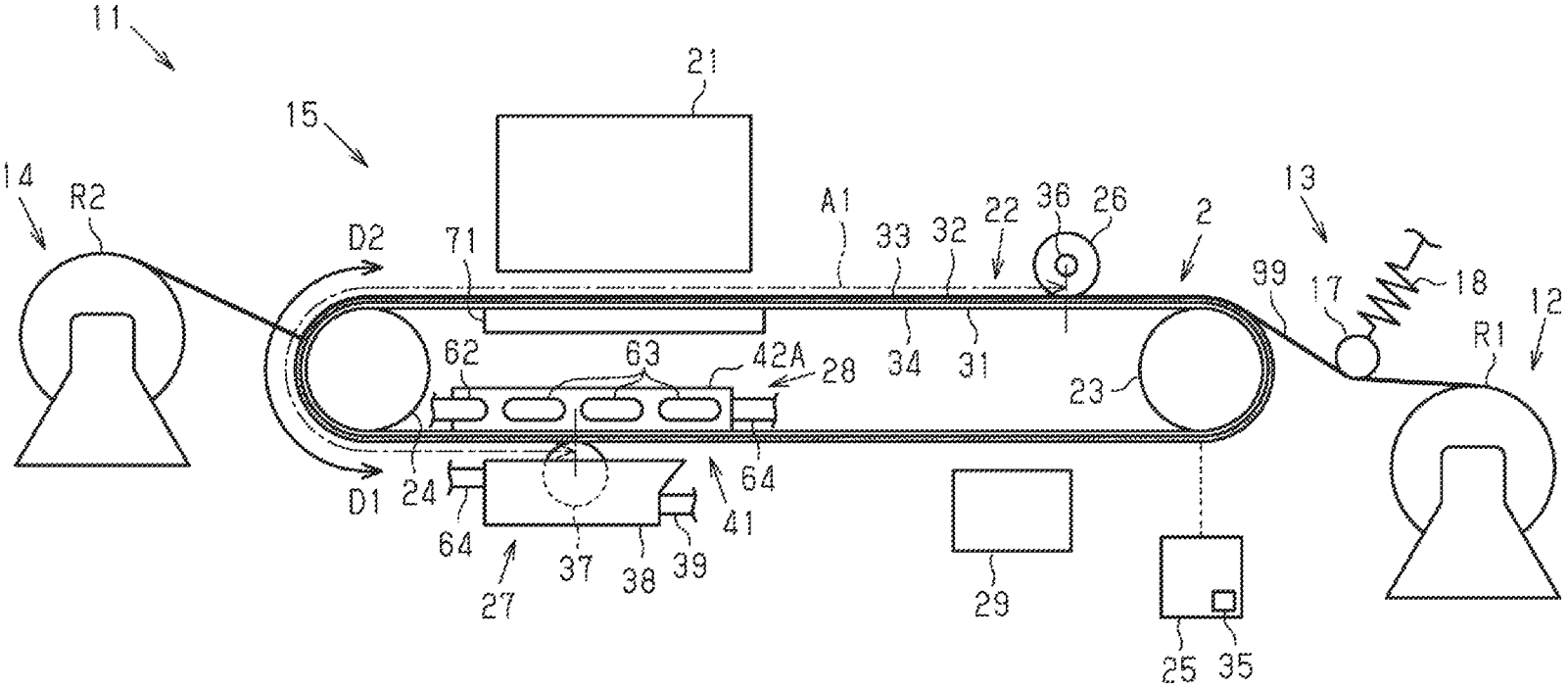
FIG. 4 is a side view schematically illustrating a second exemplary embodiment of a recording device including a recording device.

As illustrated in FIG. 4, in the second embodiment, the contacting unit 42A is opposed to the cleaning member 37 with the transporting belt 22 interposed therebetween. As a result, the contacting unit 42A supports a portion of the transporting belt 22 to which the cleaning member 37 contacts.

In the second embodiment, in the same manner as in the first embodiment, the contacting unit 42A contacts the second surface 34 downstream of the pressing unit 26 and upstream of the cleaning member 37 in the revolving direction D1 of the transporting belt 22. In the second embodiment, at least a part of the contacting unit 42 contacts the region A1 with respect to the transporting belt 22. Therefore, the cleaning member 37 contacts the adhesive layer 32 cooled by the cooling unit 28.

In the second embodiment, the recording device 15 may include a supporting unit 71 that supports a portion facing the recording unit 21 in the medium 99. The supporting unit 71 is positioned at a position opposite to the recording unit 21 with the transporting belt 22 interposed therebetween. The recording unit 21 performs recording on the portion supported by the supporting unit 71 with respect to the medium 99.

Next, functions and effects according to the second embodiment will be described.

(5) The contacting unit 42A is opposed to the cleaning member 37 with the transporting belt 22 interposed therebetween. In this case, the contacting unit 42 supports the portion of the transporting belt 22 to be cleaned by the cleaning member. As a result, the efficiency of cleaning by the cleaning member 37 is improved.

The first embodiment and the second embodiment may be modified as described below. The first embodiment, the second embodiment, and the modified examples below may be implemented in combination within a range in which a technical contradiction does not arise.

- The second roller 24 may function as a contacting unit 42. For example, the second roller 24 cools the adhesive layer 32 by the flow path 41 formed in the second roller 24. In this case as well, the contacting unit 42 contacts the region A1.
- The contacting unit 42 may be disposed at any position as long as the contacting unit 42 is in contact with the region A1. In other words, the contacting unit 42 may be in contact with the second surface 34 downstream of the pressing unit 26 and upstream of the cleaning member 37 in the revolving direction D1 of the transporting belt 22.
- The contacting unit 42 may be disposed at a position that is opposed to the recording unit 21 with the transporting belt 22 interposed therebetween, and a position that is opposed to the cleaning member 37 with the transporting belt 22 interposed therebetween. In other words, when the contacting unit 42 is the first contacting unit and the contacting unit 42A is the second contacting unit, the recording device 15 may include both the first contacting unit and the second contacting unit disposed downstream of the first contacting unit in the revolving direction D1. In this case, the supplying pipe 62 may be disposed separately for each of the contacting unit 42 and the contacting unit 42A, and the discharging pipe 64 may be disposed separately for each of the contacting unit 42 and the contacting unit 42A. In this way, water from the water source is independently supplied to each of the contacting unit 42 and the contacting unit 42A, and the cooling capacity of each of the contacting unit 42 and the contacting unit 42A is substantially equal. Alternatively, of the supplying pipe 62 and the discharging pipe 64 coupled to the contacting unit 42, the discharging pipe 64 may be used as a supplying pipe for the contacting unit 42A. That is, the contacting unit 42 may be coupled to the contacting unit 42A using the supplying pipe 62. In this way, by reducing the number of parts, maintenance such as part replacement can be prevented from becoming complicated.
- The protrusion 66 may be disposed on the inner surface of the supplying pipe 62, may be disposed on the inner surface of the connecting pipe 63, or may be disposed on the inner surface of the discharging pipe 64.
- The supplying pipe 62 and the discharging pipe 64 may be coupled to each of the plurality of the through holes 61.
- The contacting unit 42 may be constituted by resin or ceramic.
- The flow path 41 may be constituted by resin or ceramic.
- The contacting unit 42 is not limited to an aspect that constitutes a part of the flow path 41. For example, the flow path 41 and the contacting unit 42 may be disposed independently. Specifically, the flow path 41 may be configured from a metal tube, and the flow path 41 may be coupled to the contacting unit 42 so that heat can enter and exit between the flow path 41 and the contacting unit 42 which is a member independent of the tube. If the flow path 41 and the contacting unit 42 are physically connected, the transporting belt 22 can be cooled by water flowing through the flow path 41. When the flow path 41 and the contacting unit 42 are each independently disposed, the contacting unit 42, which is a member separate from the flow path 41, may be omitted. In other words, the flow path 41 itself may be the contacting unit of the present disclosure.

The shape of the protrusion 66 can be changed as appropriate. For example, at least one protrusion 66 may be formed by forming a helical groove on the inner surface of the flow path 41. In this case, by machining each end of the supplying pipe 62 and the discharging pipe 64 into a shape that can engage with the helical groove, the end portions of each of the supplying pipe 62 and the discharging pipe 64 can be screwed into the helical groove. As a result, the cooling efficiency of the transporting belt 22 by the cooling unit 28 is improved, and the supplying pipe 62 and the discharging pipe 64 can be securely fixed to the contacting unit 42.

The water source is not limited to a water supply pipe of a private facility or a water supply pipe of a camp facility. For example, a water storage tank may be disposed in a factory where the recording device 15 is installed and/or a place on which the factory is installed.

The aspects of the coupling of the supplying pipe 62, the connecting pipe 63, and the discharging pipe 64 to the through hole 61, that is to the contacting unit 42 are not limited to the embodiments described above. When the flow path 41 is formed in the contacting unit 42, as long as it is configured that water flows through the flow path 41, the aspects of the coupling of the supplying pipe 62, the connecting pipe 63, and the discharging pipe 64 to the contacting unit 42 are not limited. For example, when it is configured that water flows through the flow path 41, the number and shape of the connection tube 63 may be changed, or the connecting pipe 63 may be omitted.

The heating unit 36 may be disposed separately from the pressing unit 26.

An example of a heating unit that heats the medium 99 upstream of the recording unit 21 in the revolving direction D1 may be a drying unit 29. In other words, the medium 99 may be heated upstream of the recording unit 21 in the circulating direction D1 by at least one of the heating unit 36 and the drying unit 29.

The liquid ejected by the recording unit 21 is not limited to ink, and may be, for example, a liquid material including particles of a functional material dispersed or mixed in liquid. For example, the recording unit 21 may eject a liquid material including a material such as an electrode material or a pixel material used in manufacture of a liquid crystal display, an electroluminescent display, and a surface emitting display in a dispersed or dissolved form.

Hereinafter, technical concepts and effects thereof that are understood from the first embodiment, the second embodiment and the modified examples described above will be described.

(A) A recording device including: a recording unit that performs recording on a medium by ejecting liquid, a transporting belt that has a base material having a first surface provided with an adhesive layer on which the medium is stuck and a second surface which is a surface opposite to the first surface, and the transporting belt transports the medium, a pressing unit that presses the medium against the transporting belt, a cleaning member that cleans the adhesive layer by contacting the adhesive layer, a storage unit in which water for cleaning the cleaning member is stored, and a cooling unit having a flow path through which water flows and a contacting unit that contacts the second surface, the contacting unit being coupled to the flow path, wherein the flow path extends toward the storage unit so that water flows from the cooling unit toward the storage unit, and the contacting unit contacts the second surface downstream of the pressing unit and upstream of the cleaning member in the revolving direction of the transporting belt.

According to this configuration, the contacting unit is cooled by water flowing through the flow path in the cooling unit. The cooling unit cools the transporting belt by the contacting unit contacting the second surface. The contacting unit contacts the second surface downstream of the pressing unit and upstream of the cleaning member in the revolving direction of the transporting belt. Therefore, the cleaning member contacts the adhesive layer cooled by the cooling unit.

The adhesive layer is generally formed from a thermoplastic resin, and thus it is cured when cooled. Therefore, by the cooling unit cooling the adhesive, damage to the adhesive layer can be reduced due to contact of the cleaning member. Therefore, deterioration of the adhesive layer can be suppressed.

(B) In the recording device described above, the recording device may include a heating unit configured to heat the medium upstream of the recording unit in the revolving direction, wherein the contacting unit is opposed to the recording unit with the transporting belt interposed between the contacting unit and the recording unit.

When the heating unit heats the medium, it becomes easy to attach the medium to the adhesive layer. The reason for this is because the adhesive layer is generally formed from a thermoplastic resin, and thus, when the adhesive layer is heated, the adhesive force is improved. On the other hand, when heat of the heated medium is transferred to the recording unit, the recording unit may be adversely affected. In this respect, according to the configuration described above, the cooling unit cools the transporting belt at a position opposed to the recording unit with the transporting belt interposed therebetween, and thus the heat transferred from the medium to the recording unit can be reduced.

(C) In the recording device described above, wherein the contacting unit may be opposed to the cleaning member with the transporting belt interposed therebetween.

According to this configuration, the contact part supports the portion to be cleaned by the cleaning member on the transporting belt. As a result, the efficiency of cleaning by the cleaning member is improved.

(D) In the recording device described above, wherein the contacting unit may be made of metal.

According to this configuration, the heat is easily transferred from the transporting belt to the contacting unit, and thus the cooling efficiency of the transporting belt by the cooling unit is improved.

(E) In the recording device described above, wherein an inner surface of the flow path includes a protrusion protruding from the inner surface.

According to this configuration, a surface area of the inner surface of the flow path in which water contacts is increased by the protrusion. As a result, the heat is easily transferred from the transporting belt to the contacting unit, and thus the cooling efficiency of the transporting belt by the cooling unit is improved.

What is claimed is:

1. A recording device comprising:

a recording unit that performs recording on a medium by ejecting liquid;

a transporting belt that has a base material having a first surface provided with an adhesive layer on which the medium is stuck and a second surface which is a surface opposite to the first surface, the transporting belt transporting the medium;

a pressing unit that presses the medium against the transporting belt;

a cleaning member that cleans the adhesive layer by contacting the adhesive layer;

a storage unit in which water for cleaning the cleaning member is stored; and a cooling unit having a flow path through which water flows and a contacting unit that contacts the second surface, the contacting unit being coupled to the flow path, wherein the flow path extends toward the storage unit so that water flows from the cooling unit toward the storage unit, and the contacting unit contacts the second surface downstream of the pressing unit and upstream of the cleaning member in the revolving direction of the transporting belt.

2. The recording device according to claim 1, further comprising:

a heating unit configured to heat the medium upstream of the recording unit in the revolving direction, wherein the contacting unit is opposed to the recording unit with the transporting belt interposed between the contacting unit and the recording unit.

3. The recording device according to claim 1, wherein the contacting unit is opposed to the cleaning member with the transporting belt interposed between the contacting unit and the cleaning member.

4. The recording device according to claim 1, wherein the contacting unit is made of metal.

5. The recording device according to claim 1, wherein an inner surface of the flow path includes a protrusion protruding from the inner surface.

* * * * *